United States Patent [19]

Lewallyn

[11] 4,102,512

[45] Jul. 25, 1978

[54] SYSTEM FOR FORMING SHEET MATERIAL INTO SPIRAL ROLLS

[76] Inventor: Michael Lewallyn, P.O. Box 1361, Dalton, Ga. 30720

[21] Appl. No.: 795,772

[22] Filed: May 11, 1977

[51] Int. Cl.[2] ..... B65H 17/12

[52] U.S. Cl. ..... 242/66; 242/DIG. 3

[58] Field of Search ..... 242/66, DIG. 3, 68.7, 242/75.1, 55.1; 100/89

[56] References Cited

U.S. PATENT DOCUMENTS

| | | | |
|---|---|---|---|
| 947,007 | 1/1910 | Wheat | 242/68.7 |
| 2,706,094 | 4/1955 | Dyken | 242/DIG. 3 |
| 2,830,775 | 4/1958 | Kiesel | 242/66 X |
| 3,841,578 | 10/1974 | Dorfel | 242/66 |
| 4,002,308 | 1/1977 | Feighery | 242/66 |

*Primary Examiner*—Harvey C. Hornsby
*Assistant Examiner*—John M. Jillions
*Attorney, Agent, or Firm*—Jones, Thomas & Askew

[57] ABSTRACT

Sheet material such as carpet is moved along its length between lower and upper rollers of a cluster or rotating rollers. The rotating rollers form the sheet material into a spiral roll, and as the size of the spiral roll of sheet material increases, it urges one of the upper rollers of the cluster to open up away from the other rollers to form an upwardly facing concave arrangement of rollers, and as the spiral roll of sheet material continues to increase, it becomes supported on the upper rollers of the cluster with its free end extending downwardly between the upper rollers so that the upper rollers exert roll-up forces about a major portion of the circumference of the spiral roll of sheet material. When a predetermined length of sheet material has been accumulated in the spiral roll, the movement of the sheet material is stopped, the material is cut, and the upper rolls in the cluster of rolls are manipulated so as to eject the accumulated spiral roll of sheet material from the cluster of rollers.

8 Claims, 4 Drawing Figures

SYSTEM FOR FORMING SHEET MATERIAL INTO SPIRAL ROLLS

BACKGROUND OF THE INVENTION

Various machines have been developed for the purpose of paying out, measuring and cutting predetermined lengths of carpet and other sheet material from a large roll, measuring the sheet material, cutting the sheet material in a shorter length and rolling up the cut length for delivery to a customer. The prior art devices have included a spiral roll-up assembly, a conveyor system for moving the sheet material along its length from a supply toward the spiral roll-up assembly, a measuring system for measuring the sheet material as it is moved along its length toward the roll-up assembly, and a cutter for cutting the sheet material after a predetermined length has been accumulated in the spiral roll.

One of the problems in the prior art roll-up assemblies has been that the sheet material that is being rolled up into a spiral roll is not tightly rolled, so that a substantial amount of slack is formed in the roll. A spiral roll of sheet material with slack in the roll is likely to become wrinkled in the subsequent handling and storage of the material, the roll of material is more difficult to handle, the roll of material is more likely to become damaged when being handled, and the loosely wound roll usually takes up more room in shipment and storage.

SUMMARY OF THE INVENTION

Briefly described, the present invention comprises a system for forming sheet material and the like into a spiral roll, wherein a cluster of rollers arranged in parallel relationship with respect to one another receives the sheet material as it moves along its length between a pair of the rollers, and the rotation of the rollers tends to form the sheet material into a spiral roll. When the sheet material is first formed into a spiral roll, it tends to be engaged by all of the rollers in the cluster, and as the size of the spiral roll being formed increases, one of the upper rollers in the cluster is urged out of the cluster so that the rollers form an upwardly facing concave seat for the spiral roll, and as the spiral roll continues to increase in size, it becomes seated on the two upper rollers in the cluster with its free end extending down beneath one of the upper rollers and back to the supply of sheet material. Thus, the rollers are supporting the spiral roll of sheet material on opposite sides of the trailing free end of the sheet material and exert a tension force on the outer layer of the material in the spiral roll of sheet material around a major portion of the circumference of the spiral roll, which tends to reduce any slack that might be formed in the sheet material in the spiral roll and tends to tightly wind the roll. After a predetermined length of sheet material has been accumulated in the spiral roll, the sheet material is cut, the rolling up of the sheet material is completed, and the rollers are manipulated to eject the spiral roll from the cluster of rollers.

In order to prevent the sheet material from moving out between the cluster of rollers, the rollers are formed with alternating annular protrusions and grooves on their external surfaces so that the protrusions of one roller are received in the grooves of the next adjacent roller, and the interfitting protrusions and grooves prevent the sheet material from inadvertently escaping from the space defined between the rollers. Thus, it is an object of this invention to provide a system for forming sheet material into a spiral roll of sheet material in such a manner that the spiral roll is tightly wound.

Another object of this invention is to provide a method and apparatus for rapidly, accurately and tightly forming a spiral roll of sheet material, wherein the apparatus in inexpensive to construct, to maintain, and to operate.

Other objects, features and advantages of this invention will become apparent upon reading the following specification, when taken in conjunction with the accompanying drawings.

DETAILED DESCRIPTION

Figure 1:
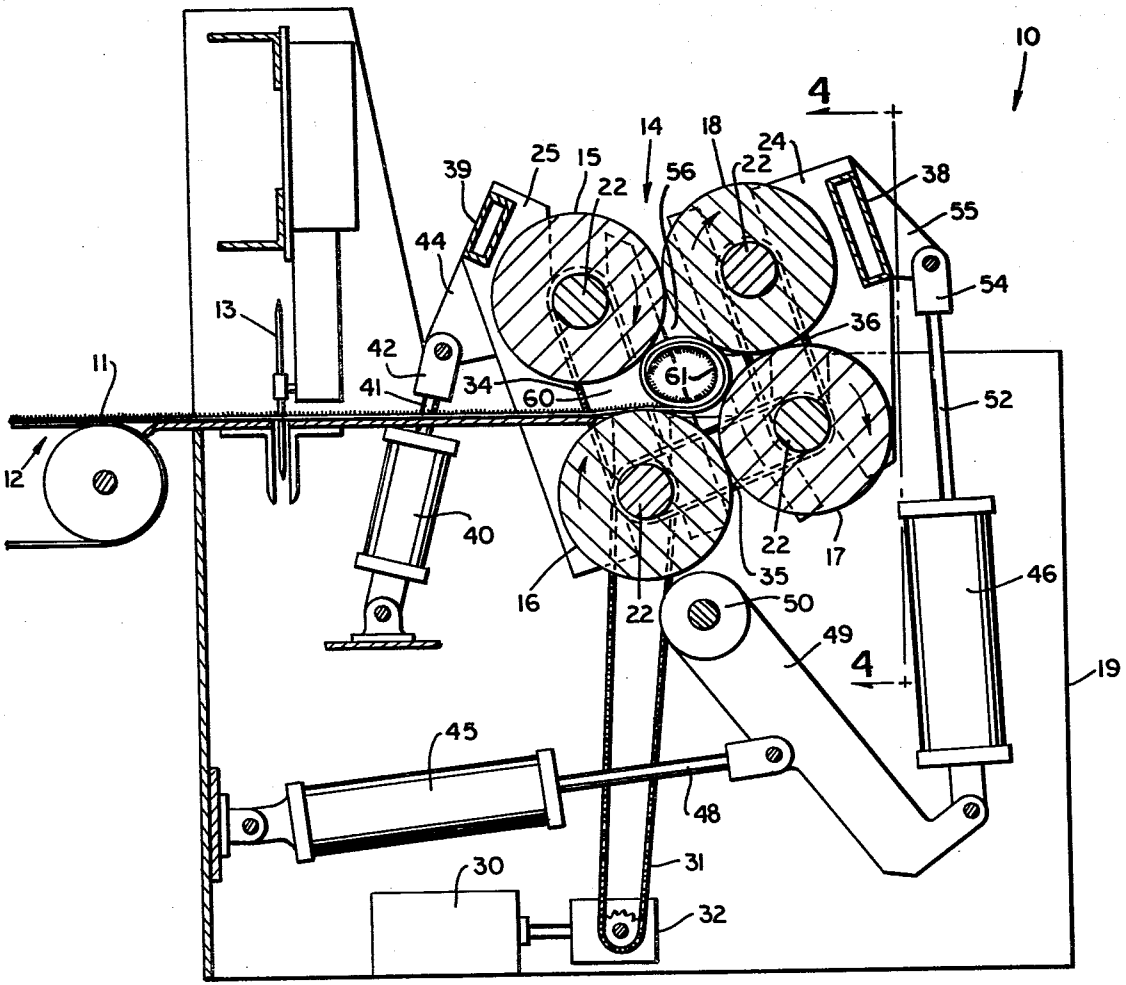
FIG. 1 is a side cross sectional view, with parts shown in dashed lines and with parts broken away, of the carpet roll-up mechanism, of the cutter, and a portion of the belt conveyor used to move the sheet material to the rollers.

Referring now in more detail to the drawings, in which like numerals indicate like parts throughout the several views, FIG. 1 illustrates the apparatus 10 for forming sheet material into a spiral roll. The apparatus receives sheet material 11 such as carpet as it moves along its length from a belt conveyor 12 through a cutting station 13 to a cluster 14 of roll-up rollers 15, 16, 17 and 18. The cluster of rollers 14 is mounted on a supporting frame 19 which includes parallel side walls such as the upright side wall 20 illustrated in FIG. 4. The rollers 15, 16, 17 and 18 are all of equal outside diameter, and each roller includes an external roll 21, an internal axle 22 rigidly connected to each other, and end bearings 23. Rollers 17 and 18 are mounted at their ends on end plates 24, while rollers 15 and 16 are mounted at their ends on end plate 25. The bearings 23 of each roller are mounted on the end plates, and the axles 22 of each roller rotate with respect to the end plates. Driving sprockets 26 are rigidly fastened to the axles of the rollers. The axles of the lower rollers 16 and 17 protrude beyond their end bearings 23 and sprockets 26 through a second pair of end bearings 28 which are mounted on the side walls 20 of the support frame 19. Additional driving sprockets 29 are mounted on the axles of the lower rollers.

A driving motor 30 is located in the lower portion of framework 19 and functions to drive the drive chain 31 through a speed reducer 32, and the drive chain 31 drives the roller 16. The rollers 15, 16, 17 and 18 are all interconnected by driving chains 34, 35 and 36 which are trained about the end sprockets 26 and 29, and the sprockets and rollers are sized so that the surface velocity of each of the rollers 15–18 is substantially equal, and the rollers rotate in the same direction of rotation. Motor 30 is a reversible motor, so that all of the rollers 15–18 rotate either in a clockwise direction or in a counterclockwise direction.

Since the end support plates 24 and 25 are mounted to end bearings 23 of the lower rollers 16 and 17, each of the upper rollers 15 and 18 can be moved in arcs about the axles 22 of their respective lower rollers 16 and 17. End plates 24 are tied together by tubing 38, while end plates 25 are tied together by tubing 39. Tubing 38 rigidifies the end plates 24 so that they are always parallel to each other and so that upper roller 18 is always maintained parallel to the lower roller 17. Tubing 39 functions in a similar manner in that it ties together end plates 25, maintains the end plates parallel to each other and maintains upper roller 15 parallel to lower roller 16.

Figure 3:
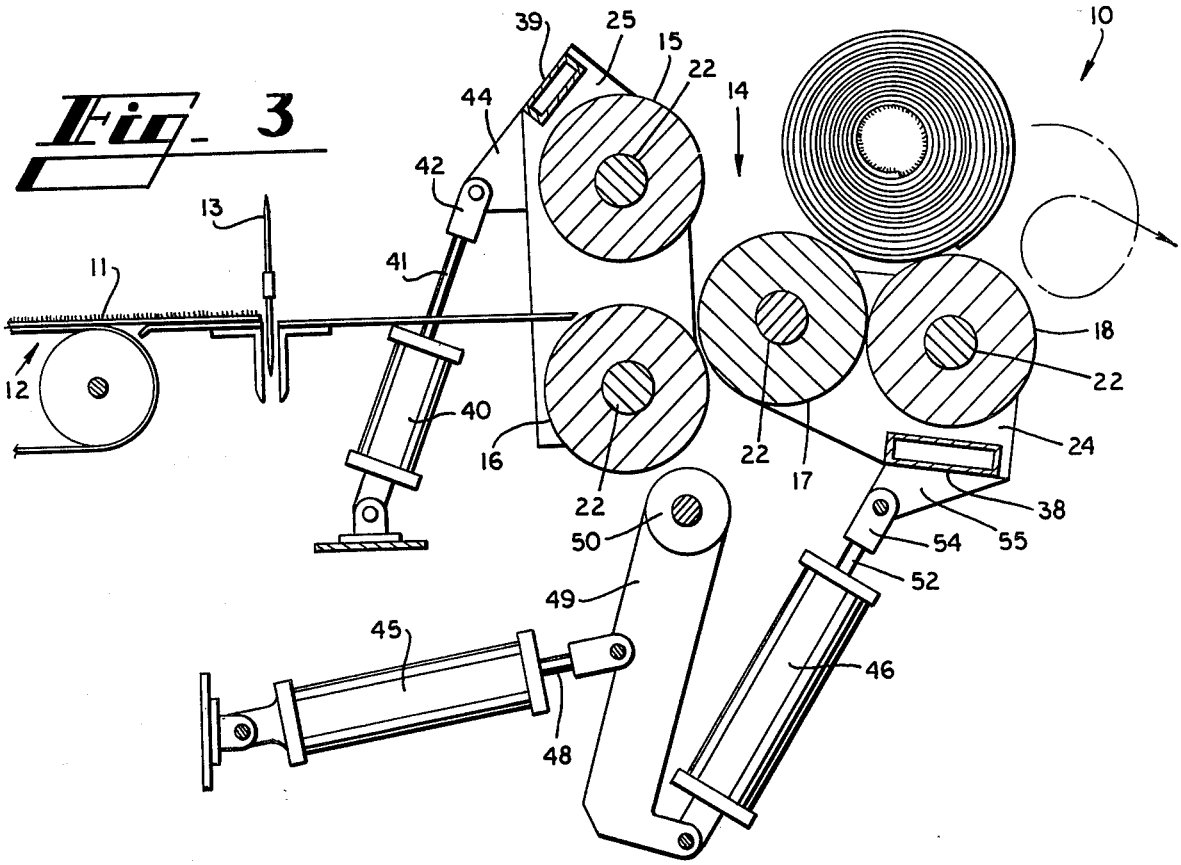
FIG. 3 is a schematic side cross sectional view, similar to FIG. 2, but illustrating the upper rollers in their eject position.

The movements of end plates 25 and upper roller 15 are controlled by a pair of fluid actuated cylinders such as the cylinder 40 illustrated in FIG. 1 at the ends of the support frame 19. The ramrod 41 of each cylinder 40 is connected by a clevis 42 to a protrusion 44 of the end plates 25. This allows the upper roller 15 to be moved from its position indicated in FIG. 1, where it is in its winding up position, to the position illustrated in FIG. 3, where it is in its reel eject position.

The pairs of fluid actuated cylinders 45 and 46 function through a compound lever arrangement to control the movement of roller 18. The cylinders 45 are supported at opposite sides of the frame 19, and their ramrods 48 are connected by clevises to the intermediate portions of levers 49 at each side of the framework. Levers 49 are pivotally mounted on shaft 50 mounted in bearings 51 at the sides of the framework. The fluid actuated cylinders 46 are each supported at the lower ends of the levers 49, and their ramrods 52 are connected by clevises 54 to the protrusions 55 on the end plates 24. When the ramrods of the fluid actuated cylinders 45 and 46 are distended as illustrated in FIG. 1, the roller 18 is in its closed position, where the cluster of rollers 14 forms a substantially closed space 56 for receiving and winding up the sheet material 11. When the fluid actuated cylinder 46 retracts its ramrod 52 (FIG. 2), the upper roller 18 is moved to its open position where the rollers 15–18 form an upwardly facing elongated concave recess, and when both cylinders 45 and 46 are retracted, the upper roller 18 is moved down to its eject position, allowing the reel of sheet material to roll off the cluster 14 of roll-up rollers.

Figure 4:
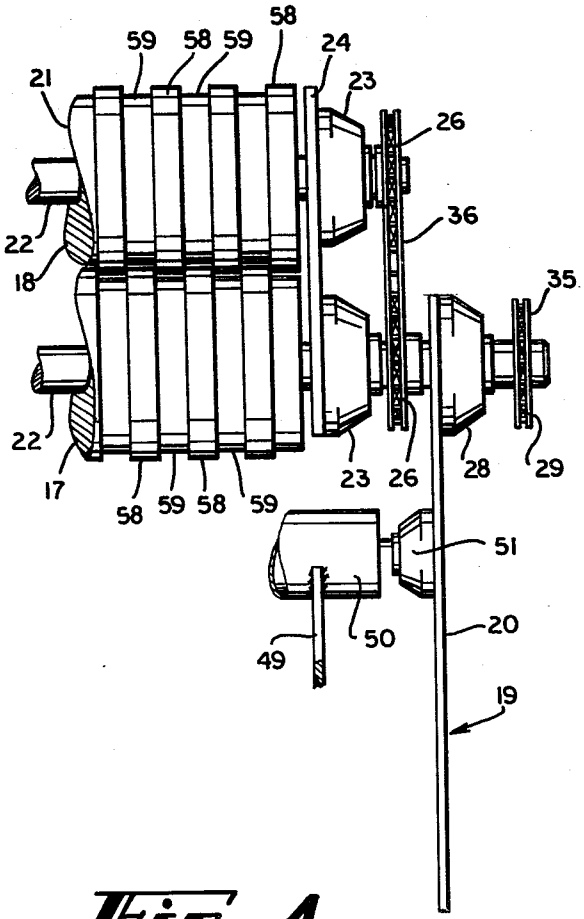
FIG. 4 is a detail view of a pair of the rollers and a portion of the frame and bearings taken along lines 4—4 of FIG. 1.

As illustrated in FIG. 4, the exterior surface of the rollers 15–18 are formed with alternating annular protrusions 58 and annular recesses 59, with the protrusions of one roller being received in the recesses of the next adjacent roller. The annular protrusions 58 can be formed from various structural arrangements, including an arrangement that would comprise a plurality of resilient bands mounted on the smooth exterior surface of the rollers. The interfitting relationship between the annular protrusions and annular recesses of rollers 16–17, 17–18 and 18–15 allows the rollers to block the inadvertent movement of the sheet material 11 between adjacent ones of the rollers as the sheet material is first received in the substantially closed space between the cluster of roll-up rollers 15–18 through the opening 60 between rollers 15 and 16.

OPERATION

When sheet material 11 is moved along its length toward the cluster 14 of roll-up rollers 15–18, the sheet material will enter the substantially closed space 56 through the gap 60 between lower roller 16 and upper roller 15. Since all of the rollers 15–18 are rotated in the same direction of rotation, the sheet material will tend to form a spiral roll 61 in the space 56, with the roll being contacted at first by all of the rollers 15–18. Since the upper roller 18 is located beyond its balance point above roller 17, the upper roller 18 will tend to maintain its position illustrated in FIG. 1 where it is in its closed position in the cluster of rollers. Also, since the pair of fluid actuated cylinders 40 are retracted and since upper roller 15 is shifted from directly above lower roller 16 and rests on cylinders 40, the upper roller 15 will maintain the position illustrated in FIG. 1.

Figure 2:
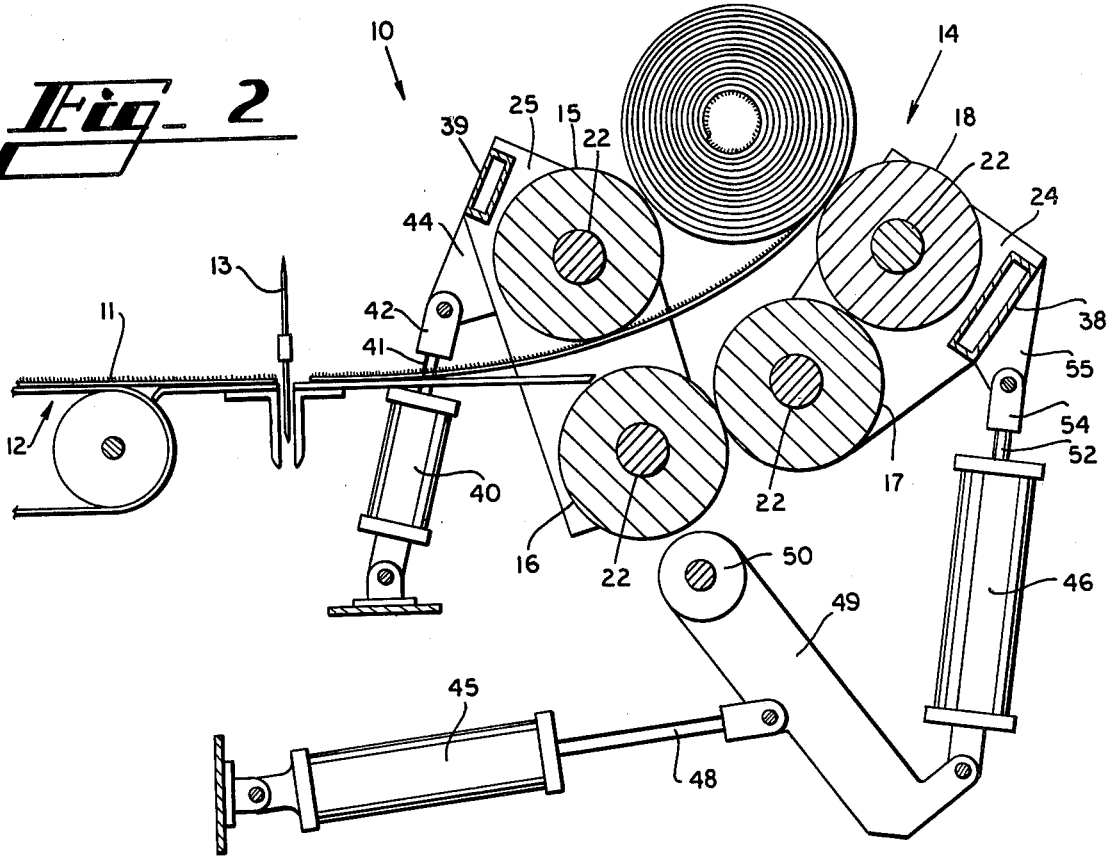
FIG. 2 is a schematic side elevational view of the cluster of rollers and the power means used to control the movements of the upper rollers, showing the upper rollers in their open positions.

As the spiral roll of sheet material increases in size during the roll-up operation, roller 18 will be urged from its position of rest in FIG. 1 up over the dead center of roller 17, and eventually toward the position illustrated in FIG. 2, which is its open position. In the meantime, while the spiral roll of sheet material is small and is growing, all four of the rollers 15–18 are in contact with the exterior layer of the spiral roll of sheet material, and the rotation of the rollers tends to pull the sheet material from its supply and therefore form tension in the sheet material at all four points of contact on the external layer of the sheet material in the spiral roll. This tends to cause the spiral roll to be tightly wound in the initial stages of winding.

The fluid circuit to fluid actuated cylinders 46 includes a needle bleed valve (not shown) that allows a slow retraction of the ramrod 52 as the roller 18 is urged by the ever-increasing size of the spiral roll of sheet material, so that roller 18 tends to maintain contact with the external layer of sheet material on the spiral roll as the size of the spiral roll increases. As the diameter of the spiral roll of sheet material begins to increase to a size larger than the space between the adjacent surfaces of the upper rollers 15 and 18, the spiral roll will begin to be supported solely by the upper rollers 15 and 18 (FIG. 2). This results in the upper roller 15 contacting the lower portion of the spiral roll of sheet material on one side of the free end of the sheet material and the other upper roller 18 contacting the spiral roll on the other side of the free end of the sheet material. Thus, the back tension of the free end of the sheet material tends to work against the rotational movement of the upper rollers 15 and 18, so that rollers 15 and 18 both apply roll-up force to the external layer of sheet material in the spiral roll. The result is that tension is created in the external layer of the spiral roll from the point of contact of roller 15 with the spiral roll around the upper surface of the spiral roll to the point of contact of the spiral roll with roller 18, and then the combined tension forces from both rollers 15 and 18 are applied back through the free end of the sheet material toward its source of supply. This assures that the spiral roll of sheet material is tightly wound and in a compact profile. In addition, as the spiral roll of sheet material increases in size, the surface of roller 15 tends to brush against the surface of the sheet material (FIG. 2). If the sheet material is pile carpet or other pile material with the pile facing roller 15, the brushing effect of roller 15 and the force of gravity will tend to lay the pile of the material over in one direction, so that the pile will be uniformly laid in the spiral roll of sheet material.

While this invention has been described in detail with particular reference to preferred embodiments thereof, it will be understood that variations and modifications can be effected within the spirit and scope of the invention as described hereinbefore and as defined in the appended claims.

I claim:

1. Apparatus for forming sheet material and the like into a spiral roll comprising a support frame, first and second fixed axis rollers mounted on said support frame in closely spaced parallel side-by-side relationship with the second roller at a higher elevation than the first roller, a third roller positioned over said first roller and in closely spaced parallel relationship with respect to said first roller and with its axis of rotation located on the side of the axis of said first roller which is opposite from said second roller, a fourth roller positioned adjacent said second roller in a closely spaced parallel relationship with respect to said second roller and movable in an arc about said second roller from a first position where it is above and between the first and second rollers, a second position where it is above said second roller and on the side of said second roller opposite to said first roller, and a third position where it is lower than and on the side of said second roller opposite to said first roller, drive means for simultaneously rotating all of said rollers in the same direction of rotation, and power means for moving said fourth roller to its first, second and third positions, whereby sheet material is movable along its length between said first and third rollers when said fourth roller is in its first position and the rotation of the rollers begins to form the sheet material in a spiral roll and the spiral roll is contacted by all of the rollers, and as the size of the spiral roll increases the fourth roller is moved by the spiral roll from its first position to its second position and the spiral roll becomes progressively more supported on the third and fourth rollers.

2. The apparatus of claim 1 and wherein said drive means is constructed and arranged to rotate all of said rollers at substantially the same surface velocity.

3. The apparatus of claim 1 and wherein at least some of said rollers include a plurality of annular protrusions and intermediate annular recesses with the protrusions of one roller being received in the recesses of an adjacent roller.

4. Apparatus for forming sheet material and the like into a spiral roll comprising a cluster of rollers with their axes of rotation parallel to one another and power means for rotating said rollers, said rollers comprising first and second lower rollers in adjacent side-by-side positions, a first upper roller spaced from and positioned over said first lower roller, and a second upper roller positioned adjacent and movable in an arc about said second lower roller from a first position where the first and second upper rollers are juxtaposed and form with the lower rollers a substantially closed interior space for receiving sheet material through the space between said first lower roller and said first upper roller to a second position where the rollers form with one another an approximately U-shape arrangement with the upper rollers separated a distance less than the combined diameters of said first and second lower rollers, power means for urging said second upper roller through its arc of movement between its first position and its second position and for yieldably resisting the movement of said second upper roller from its first position to its second position, whereby as sheet material is moved along its length between the first lower roller and the first upper roller into the interior space formed by the rollers the sheet material is engaged by all of the rollers and formed in a spiral roll, and as the size of the spiral roll of sheet material increases the spiral roll urges the second upper roller through its arc of movement away from its first position adjacent the first upper roller to its second position and when the diameter of the spiral roll exceeds the space between the first and second upper rollers the spiral roll becomes supported by the upper rollers.

5. A method of forming a spiral roll of sheet material and the like comprising moving the sheet material along its length into a space defined by four parallel rollers positioned in an approximately rectangular arrangement with respect to one another with a pair of lower stationary rollers and a pair of movable upper rollers positioned over the lower rollers with the sheet material moving over a first lower roller and beneath a first upper roller, rotating all of the rollers at approximately the same surface velocity and in the same angular direction to form the sheet material into a spiral roll, supporting the spiral roll of sheet material primarily on the two rollers when the spiral roll of sheet material is small, urging the second movable upper roller in an arcuate path around the second lower roller with the spiral roll of sheet material as the spiral roll of sheet material increases in size, and supporting the spiral roll of sheet material on the two upper rollers when the spiral roll of sheet material has increased in size to a diameter larger than the space between the two upper rollers.

6. The method of claim 5 and further including the step of brushing the surface of the sheet material with the first upper roller as the sheet material moves along its length between the first upper roller and the first lower roller into the space defined by the four rollers.

7. The method of claim 5 and further including the step of continuously maintaining the spiral roll of sheet material supported on the rollers in contact with the first upper roll.

8. A method of forming sheet material and the like into a spiral roll comprising moving the sheet material along its length between a lower roller and an upper roller into a space defined by a group of at least one lower and at least two upper rollers arranged parallel to one another and in a cluster, rotating the rollers of the cluster of rollers in the same direction of rotation to form the sheet material into a spiral roll, pivoting at least one upper roller of the cluster of rollers away from the space to open the cluster of rollers at the top in response to an increase in the size of the spiral roll of sheet material, and supporting the spiral roll of sheet material first on the lower roller in the cluster of rollers and subsequently on the upper rollers in the cluster as the size of the spiral roll of sheet material increases.

* * * * *